US010344240B2

(12) United States Patent
Fabre

(10) Patent No.: US 10,344,240 B2
(45) Date of Patent: Jul. 9, 2019

(54) CONCENTRATED MULTI-FUNCTIONAL FUEL ADDITIVE PACKAGES

(71) Applicant: The Lubrizol Corporation, Wickliffe, OH (US)

(72) Inventor: Clara Fabre, Turin (IT)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

(21) Appl. No.: 15/314,985

(22) PCT Filed: May 27, 2015

(86) PCT No.: PCT/US2015/032639
§ 371 (c)(1),
(2) Date: Nov. 30, 2016

(87) PCT Pub. No.: WO2015/183929
PCT Pub. Date: Dec. 3, 2015

(65) Prior Publication Data

US 2017/0121621 A1 May 4, 2017

Related U.S. Application Data

(60) Provisional application No. 62/005,022, filed on May 30, 2014.

(51) Int. Cl.

| | |
|---|---|
| ***C10L 10/04*** | (2006.01) |
| ***C10L 1/22*** | (2006.01) |
| ***C10L 10/08*** | (2006.01) |
| ***C10L 1/18*** | (2006.01) |
| ***C10L 1/10*** | (2006.01) |
| ***C10L 1/188*** | (2006.01) |
| ***C10L 1/224*** | (2006.01) |
| *C10L 1/16* | (2006.01) |
| *C10L 1/183* | (2006.01) |
| *C10L 1/19* | (2006.01) |
| *C10L 1/232* | (2006.01) |

(52) U.S. Cl.
CPC ..... *C10L 10/04* (2013.01); *C10L 1/10* (2013.01); *C10L 1/18* (2013.01); *C10L 1/1883* (2013.01); *C10L 1/22* (2013.01); *C10L 1/224* (2013.01); *C10L 10/08* (2013.01); *C10L 1/1616* (2013.01); *C10L 1/1832* (2013.01); *C10L 1/1881* (2013.01); *C10L 1/19* (2013.01); *C10L 1/232* (2013.01); *C10L 2200/0259* (2013.01); *C10L 2230/081* (2013.01)

(58) Field of Classification Search
CPC combination set(s) only.
See application file for complete search history.

(56) References Cited

U.S. PATENT DOCUMENTS

| | | | | |
|---|---|---|---|---|
| 5,551,957 | A | 9/1996 | Cunningham | |
| 2003/0196372 | A1 | 10/2003 | Wolf | |
| 2006/0254535 | A1 | 11/2006 | Valentine | |
| 2012/0210966 | A1 | 8/2012 | Wagner et al. | |
| 2014/0045734 | A1* | 2/2014 | Burrington | C10L 1/14 508/189 |

FOREIGN PATENT DOCUMENTS

| | | |
|---|---|---|
| GB | 2259522 | 3/1993 |
| GB | 2259522 A | 3/1993 |

OTHER PUBLICATIONS

European Patent Office, International Search Report for International Patent Application No. PCT/US2015/032639, dated Oct. 9, 2015.
European Patent Office, Written Opinion, International Patent Application No. PCT/US2015/032639, dated Oct. 9, 2015.

* cited by examiner

*Primary Examiner* — Ellen M McAvoy
*Assistant Examiner* — Chantel L Graham
(74) *Attorney, Agent, or Firm* — Iken Sans; Christopher Demas; Teresan Gilbert

(57) ABSTRACT

The disclosed technology relates to a concentrated multi-functional additive that can be continuously dosed in internal combustion engines.

13 Claims, No Drawings

CONCENTRATED MULTI-FUNCTIONAL FUEL ADDITIVE PACKAGES

FIELD OF THE INVENTION

The disclosed technology relates to a concentrated multi-functional additive that can be continuously dosed in internal combustion engines.

BACKGROUND OF THE INVENTION

New engine technologies, such as diesel engines with a common-rail system and high pressure direct fuel injection, are finely tuned systems that are presenting new types of challenges or exacerbating challenges found in earlier engine technology. These new technologies are increasingly becoming more sensitive to fuel quality.

On top of the new engine technologies, fuel quality issues have been observed in some countries which cause issues in internal combustion engines, such as, for example, injector fouling due, for example, to fuel contamination, excessive wear of metal parts and corrosion due to low fuel lubricity, gums and other deposit formations due to fuel oxidation (e.g., in low quality biofuels).

Accordingly, new fuel additive technology is needed to ensure new engine technologies function properly and to deal with issues of poor fuel quality. By "fuel additive" it is meant here any additive allowing improvement in the distribution of the fuel in the engine and/or improvement in the operating performances of the engine and/or improvement in the operating stability of the engine over time.

Current solutions to prevent engine damage include after-market products in bottles or complex on-board dosing equipment with large rigid tanks, pumps, electronics and connections. It would be desirable to provide an additive package that can function to provide multiple benefits in performance over various qualities of fuels. It would be further beneficial if the multi-functional additive package could be provided in a form that can be continuously delivered to the engine, for example, from a small tank in a fuel filter, thereby relieving the consumer of the burden of constantly having to add an additive to their fuel at every fill up.

SUMMARY OF THE INVENTION

The disclosed technology provides a multi-functional additive package that can deliver 1) multiple performance benefits in an internal combustion engine, such as, for example, coking prevention, coking removal, internal diesel injector deposit prevention, lubricity improvement, anti-oxidancy, and corrosion protection, 2) at a very low treat rate, and 3) while allowing the product to be stable over a large range of temperatures, such as, for example −30° C. to +70° C.

The multi-functional additive can be delivered to a fuel composition at a concentration of between about 100 to about 500 ppm on a weight basis.

In an embodiment, the multi-functional additive can be used in an on-board dosing system.

The multi-functional additive package can include about 5 or 10 to about 90% by weight of a deposit control additive blend of at least one oxygen-containing compound and at least one nitrogen-containing compound, about 2.4 or 10 to about 90% by weight of at least one lubricity improver and about 2.5 or 10 to less than about 50% by weight of at least one solvent. The multi-functional additive package can additionally include about 0.1 to about 30% by weight of at least one compatibilizer mixture. The multi-functional additive can additionally include from about 5 to about 90% by weight of at least one anti-oxidant.

In one embodiment, the at least one oxygen containing compound can include a hydrocarbyl-substituted acylating agent, and in a further embodiment the at least one oxygen containing compound comprises a polyisobutylene succinic acid or polyisobutylene succinic anhydride.

In one embodiment the at least one nitrogen-containing compound can include the reaction product of a hydrocarbyl-substituted acylating agent and an amine or polyamine having from 2 to 18 carbon atoms and in another embodiment the at least one nitrogen-containing compound can comprise a polyisobutylene succinimide or a quaternized salt thereof.

In an embodiment, the ratio of the at least one oxygen-containing compound to the at least one nitrogen-containing compound can be from about 1:0.1 to about 1:10 moles per mole.

In an embodiment, the compatibilizer mixture can contain a compatibilizer and an alcohol. In an embodiment, the ratio of compatibilizer to alcohol in the compatibilizer mixture can be from about 2:0.1 to about 5:12 mole per mole. In a further embodiment, the ratio of the compatibilizer mixture to the lubricity improver can be from about 2.1:25 to about 17:25 mole per mole. In yet another embodiment, the ratio of the compatibilizer to alcohol (C/A) in the compatibilizer mixture can be from about 1:3 to about 1:1 ppm wt/wt. In another embodiment the ratio of the compatibilizer mixture to the lubricity improver (CM/L) may be from about 1:5 to about 1:2.5 ppm wt/wt.

In another embodiment, there is provided a fuel composition for fueling an internal combustion engine including a diesel fuel and a multi-functional additive package of the present technology. In certain embodiments the multi-functional additive package can be present in the diesel fuel of the fuel composition in a concentration of between about 100 to about 500 ppm on a weight basis.

In one embodiment the multi-functional additive package can have a minimum viscosity index over a range of temperatures to allow delivery of additive at low temperatures as well as a consistent delivery of the additive. In an embodiment, the multi-functional additive can be formulated to meet various viscosity specifications, and in an embodiment, can have a viscosity of around (±3) 25 cSt at 40° C. as measured according to ASTM D445.

In one embodiment, there is additionally provided a method of operating an internal combustion engine comprising providing to a diesel fuel a multi-functional additive package of the present technology at a concentration of between about 100 to about 500 ppm wt/wt, and operating the engine.

DETAILED DESCRIPTION OF THE INVENTION

Various features and embodiments will be described below by way of non-limiting illustration.

The technology provides a concentrated multi-functional additive package comprising (A) a deposit control additive blend of (I) at least one oxygen-containing compound, and (II) at least one nitrogen-containing compound, (B) a lubricity improver, and (C) a solvent. The concentrated multi-functional additive package can also comprise, in addition to (A), (B), and (C), (D) a compatibilizer mixture, and optionally (E) an antioxidant.

The deposit control additive blend can be present from about 2.4 or 2.5 or even from about 10 to about 90% by weight of the multi-functional additive package. The deposit control additive blend can also be present from about 15 to about 70% by weight, or from about 20 to about 50% by weight of the multi-functional additive package. In an embodiment, the ratio of the at least one oxygen-containing compound to the at least one nitrogen-containing compound in the deposit control additive blend can be from about 1:0.1 to about 1:10 moles per mole, or from about 1:0.5 to about 1:8, or even 1:1 to 1:6 moles per mole.

The at least one lubricity improver can be present in the multi-functional additive package from about 2.4 or 2.5 or even from about 10 to about 90% by weight of the multi-functional additive package, or from about 15 to about 70% by weight, or from about 20 to about 50% by weight of the multi-functional additive package.

The at least one solvent can be present in the multi-functional additive package from about 2.4 or 2.5 or even from about 10 to less than about 50% by weight of the multi-functional additive package, or even from about 15 to about 45% by weight, or from about 20 to about 40% by weight of the multi-functional additive package.

The optional at least one compatibilizer mixture of the multi-functional additive package can be present from about 0.1 to about 30% by weight of the multi-functional additive package, or from about 0.5 to about 20% by weight, or from about 1 to about 10% by weight of the multi-functional additive package. In an embodiment, the compatibilizer mixture can comprise a compatibilizer and an alcohol in a ratio of from about 2:0.1 to about 5:12 on a molar basis. In an embodiment, the compatibilizer mixture can be present in a ratio of compatibilizer mixture to lubricity improver of about 2.1:25 to about 17:25 on a molar basis.

The optional at least one antioxidant of the multi-functional additive package can be present from about 5 to about 90% by weight of the multi-functional additive package, or from about 10 to about 70% by weight, or from about 20 to about 50% by weight of the multi-functional additive package.

Deposit Control Additive Blend

Intermediates

The concentrated multi-functional additive package can include a deposit control additive blend having at least one oxygen-containing compound and at least one nitrogen-containing compound.

The deposit control additive blend, when used in the compositions and method described herein, can reduce the amount of deposits that form inside the engine in which they are used and/or increase the amount of deposit removal inside said engines. In some embodiments the deposit control additive blend reduces the formation of and/or removes injector deposits. The deposit control additive blend may also improve the corrosion inhibition of the fuel and/or reduce the tendency of fuel compositions in which they are used to pick up metals.

The oxygen-containing compounds and nitrogen containing compounds of the deposit control additive blend can both be derived from the same intermediates, which can comprise a substituted hydrocarbon with at least two carboxy functionalities in the form of acids or in the form of an anhydride. In some embodiments the intermediate is a hydrocarbon substituted with at least two carboxy functionalities in the form of acids or anhydrides. In other embodiments the intermediate is a hydrocarbyl-substituted succinic acylating agent. In other embodiments the intermediate is a dimer acid compound. In still other embodiments the intermediate includes a combination of two or more of the additives described in this section.

The intermediates are generally considered to be nitrogen-free (they do not contain a nitrogen atom), however is it considered that small amounts of nitrogen may be present in the intermediates, and even a small number of nitrogen atoms may be present in some of the intermediate molecules. These small amounts of nitrogen may come from impurities found in the materials used to prepare the intermediates or other similar sources. The possibility of such small amounts of nitrogen has been contemplated and is considered to be within the scope of the invention. In some embodiments the intermediates contain less than 100 ppm of nitrogen and in other embodiments less than 50, 20 or even 10 ppm of nitrogen. In still other embodiments the intermediates contain less than 5 ppm of nitrogen, less than 100 ppb, or are even truly free of measurable nitrogen.

The intermediates include dimer acids. In some embodiments, the dimer acid is derived from C10 to C20 fatty unsaturated carboxylic acids, C12 to C18 unsaturated acids, and/or C16 to C18 unsaturated acids.

The intermediates include succinic acids, halides, anhydrides and combination thereof. In some embodiments the agents are acids or anhydrides, and in other embodiments the agents are anhydrides, and in still other embodiments the agents are hydrolyzed anhydrides. As set forth above, the intermediates can be a substituted hydrocarbon additive. The hydrocarbon of the substituted hydrocarbon additive and/or the primary hydrocarbyl group of the hydrocarbyl-substituted succinic acylating agent generally contains an average of at least about 8, or about 30, or about 35 up to about 350, or to about 200, or to about 100 carbon atoms. In one embodiment, the hydrocarbyl group is derived from a polyalkene. In other words the nitrogen free additive may be a hydrocarbyl substituted succinic acid, a hydrocarbyl substituted succinic anhydride, a hydrolyzed hydrocarbyl substituted succinic anhydride, or any combination thereof.

The polyalkene may be characterized by a Mn (number average molecular weight) of at least about 300. Generally, the polyalkene is characterized by an Mn of about 500, or about 700, or about 800, or even about 900 up to about 5000, or to about 2500, or to about 2000, or even to about 1500. In another embodiment n varies between about 300, or about 500, or about 700 up to about 1200 or to about 1300.

The polyalkenes include homopolymers and interpolymers of polymerizable olefin monomers of 2 to about 16 or to about 6, or to about 4 carbon atoms. The olefins may be monoolefins such as ethylene, propylene, 1-butene, isobutene, and 1-octene; or a polyolefinic monomer, such as diolefinic monomer, such 1,3-butadiene and isoprene. In one embodiment, the interpolymer is a homopolymer. An example of a polymer is a polybutene. In one instance about 50% of the polybutene is derived from isobutylene. The polyalkenes are prepared by conventional procedures.

In one embodiment, the hydrocarbyl groups are derived from polyalkenes having an n of at least about 1300, or about 1500, or about 1600 up to about 5000, or to about 3000, or to about 2500, or to about 2000, or to about 1800, and the Mw/Mn is from about 1.5 or about 1.8, or about 2, or to about 2.5 to about 3.6, or to about 3.2. In some embodiments the polyalkene is polyisobutylene with a molecular weight of 800 to 1200. The preparation and use of the intermediates in the form of substituted hydrocarbons and/or substituted succinic acylating agents, wherein the hydrocarbon and/or substituent is derived from such polyalkenes are described in U.S. Pat. Nos. 3,172,892 and 4,234,435, the disclosures of which are hereby incorporated by reference.

In another embodiment, intermediates in the form of a substituted hydrocarbon and/or succinic acylating agent is prepared by reacting the above described polyalkene with an excess of maleic anhydride to provide substituted succinic acylating agents wherein the number of succinic groups for each equivalent weight of substituent group is at least 1.3, or to about 1.5, or to about 1.7, or to about 1.8. The maximum number generally will not exceed 4.5, or to about 2.5, or to about 2.1, or to about 2.0. The polyalkene here may be any of those described above.

In another embodiment, the hydrocarbon and/or hydrocarbyl group contains an average from about 8, or about 10, or about 12 up to about 40, or to about 30, or to about 24, or to about 20 carbon atoms. In one embodiment, the hydrocarbyl group contains an average from about 16 to about 18 carbon atoms. In another embodiment, the hydrocarbyl group is tetrapropenyl group. In one embodiment, the hydrocarbyl group is an alkenyl group.

The hydrocarbon and/or hydrocarbyl group may be derived from one or more olefins having from about 2 to about 40 carbon atoms or oligomers thereof. These olefins are preferably alpha-olefins (sometimes referred to as mono-1-olefins) or isomerized alpha-olefins. Examples of the alpha-olefins include ethylene, propylene, butylene, 1-octene, 1-nonene, 1-decene, 1-dodecene, 1-tridecene, 1-tetradecene, 1-pentadecene, 1-hexadecene, 1-heptadecene, 1-octadecene, 1-nonadecene, 1-eicosene, 1-henicosene, 1-docosene, 1-tetracosene, etc. Commercially available alpha-olefin fractions that may be used include the $C_{15-18}$ alpha-olefins, $C_{12-16}$ alpha-olefins, $C_{14-16}$ alpha-olefins, $C_{14-18}$ alpha-olefins, $C_{16-18}$ alpha-olefins, $C_{16-20}$ alpha-olefins, $C_{22-28}$ alpha-olefins, etc. In one embodiment, the olefins are $C_{16}$ and $C_{16-18}$ alpha-olefins. Additionally, $C_{30}$+ alpha-olefin fractions can be used. In one embodiment, the olefin monomers include ethylene, propylene and 1-butene.

Isomerized alpha-olefins are alpha-olefins that have been converted to internal olefins. The isomerized alpha-olefins suitable for use herein are usually in the form of mixtures of internal olefins with some alpha-olefins present. The procedures for isomerizing alpha-olefins are well known to those in the art. Briefly these procedures involve contacting alpha-olefin with a cation exchange resin at a temperature in a range of about 80° to about 130° C. until the desired degree of isomerization is achieved. These procedures are described for example in U.S. Pat. No. 4,108,889 which is incorporated herein by reference.

The mono-olefins may be derived from the cracking of paraffin wax. The wax cracking process yields both even and odd number $C_{6-20}$ liquid olefins of which 85% to 90% are straight chain 1-olefins. The balance of the cracked wax olefins is made up of internal olefins, branched olefins, diolefins, aromatics and impurities. Distillation of the $C_{6-20}$ liquid olefins, obtained from the wax cracking process, yields fractions (e.g., $C_{15-18}$ alpha-olefins) which are useful in preparing the succinic acylating agents.

Other mono-olefins can be derived from the ethylene chain growth process. This process yields even numbered straight-chain 1-olefins from a controlled Ziegler polymerization. Other methods for preparing the mono-olefins include chlorination-dehydrochlorination of paraffin and catalytic dehydrogenation of paraffins.

The above procedures for the preparation of mono-olefins are well known to those of ordinary skill in the art and are described in detail under the heading "Olefins" in the *Encyclopedia of Chemical Technology*, Second Edition, Kirk and Othmer, Supplement, Pages 632, 657, Interscience Publishers, Div. of John Wiley and Son, 1971, which is hereby incorporated by reference for its relevant disclosures pertaining to methods for preparing mono-olefins.

Succinic acylating agents are prepared by reacting the above-described olefins, isomerized olefins or oligomers thereof with unsaturated carboxylic acylating agents, such as itaconic, citraconic, or maleic acylating agents at a temperature of about 160°, or about 185° C. up to about 240° C., or to about 210° C. In one embodiment, the unsaturated acylating agents may be maleic acylating agents. The procedures for preparing the acylating agents are well known to those skilled in the art and have been described for example in U.S. Pat. No. 3,412,111; and Ben et al, "The Ene Reaction of Maleic Anhydride With Alkenes", J.C.S. Perkin II (1977), pages 535-537. These references are incorporated by reference for their disclosure of procedures for making the above acylating agents. In one embodiment, the alkenyl group is derived from oligomers of lower olefins, i.e., olefins containing from 2 to about 6, or about 4 carbon atoms. Examples of these olefins include ethylene, propylene and butylene.

The olefin, olefin oligomer, or polyalkene may be reacted with the carboxylic reagent such that there is at least one mole of carboxylic reagent for each mole of olefin, olefin oligomer, or polyalkene that reacts. An excess of carboxylic reagent may be used. In one embodiment, this excess is between about 5% to about 25%. In another embodiment, the excess is greater than 40%, or greater than 50%, and even greater than 70%.

The conditions, i.e., temperature, agitation, solvents, and the like, for forming a hydrocarbyl-substituted succinic acylating agent, are known to those in the art. Examples of patents describing various procedures for preparing useful acylating agents include U.S. Pat. No. 3,172,892 (Le Suer et al.); U.S. Pat. No. 3,215,707 (Rense); U.S. Pat. No. 3,219,666 (Norman et al); U.S. Pat. No. 3,231,587 (Rense); U.S. Pat. No. 3,912,764 (Palmer); U.S. Pat. No. 4,110,349 (Cohen); and U.S. Pat. No. 4,234,435 (Meinhardt et al); and U.K. 1,440,219. The disclosures of these patents are hereby incorporated by reference.

In some embodiments the substituted hydrocarbon additives and/or hydrocarbyl substituted succinic acylating agents suitable for use as the oxygen containing compound contain di-acid functionality. In other embodiments, which may be used alone or in combination with the embodiments described above, the hydrocarbyl group of the hydrocarbyl substituted succinic acylating agent is derived from polyisobutylene and the di-acid functionality of the agent is provided by a carboxylic acid group, for example a hydrocarbyl substituted succinic acid.

In some embodiments the hydrocarbyl substituted acylating agent comprises one or more hydrocarbyl substituted succinic anhydride groups. In some embodiments the hydrocarbyl substituted acylating agent comprises one or more hydrolyzed hydrocarbyl substituted succinic anhydride groups.

In some embodiments the hydrocarbyl substituents of the acylating agents described above are derived from homopolymers and/or copolymers containing 2 to 10 carbon atoms. In some embodiments the hydrocarbyl substituents of any of the acylating agents described above are derived from polyisobutylene.

Oxygen-Containing Compound

The intermediates described above can be employed to prepare the oxygen-containing compounds. The intermediates themselves can be employed as oxygen containing compounds, for example, in the form of an acid or anhydride. The intermediates can also be esterified or partially esterified with a $C_2$ to C18 alcohol, or a C3 to C15, or a C4 to C12 alcohol, and employed as the oxygen-containing compound.

Nitrogen-Containing Compound

The intermediates described above can be employed to prepare the nitrogen-containing compounds. The nitrogen-containing compound can be derived from the reaction of the intermediates and a compound having a nitrogen atom as well as an oxygen or nitrogen atom capable of condensing with the intermediate. The nitrogen-containing compound can contain quaternized nitrogen or be free of quaternized nitrogen.

Typically, the compound having an oxygen or nitrogen atom capable of condensing with the intermediate determines whether the resulting compound contains an amide group or an ester group. In some embodiments, the non-quaternized compound, and so any resulting quaternized compound is free of any imide groups. In some embodiments, the non-quaternized compound, and so any resulting quaternized compound is free of any ester groups. In these embodiments the compound contains at least one, or just one, amide group.

In one embodiment, the compound having an oxygen or nitrogen atom capable of condensing with the acylating agent and further having a tertiary amino group is represented by the following formulas:

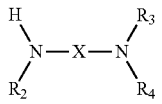

(VI)

wherein X is an alkylene group containing 1 to 4 carbon atoms; $R^2$ is hydrogen or a hydrocarbyl group; and $R^3$ and $R^4$ are hydrocarbyl groups; and

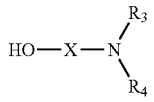

(VII)

wherein X is a alkylene group containing 1 to 4 carbon atoms and $R^3$ and $R^4$ are hydrocarbyl groups.

Examples of compounds capable of condensing with the intermediates, include but are not limited to: 1-aminopiperidine, 1-(2-aminoethyl)piperidine, 1-(3-aminopropyl)-2-pipecoline, 1-methyl-(4-methylamino)piperidine, 4-(1-pyrrolidinyl)piperidine, 1-(2-aminoethyl)pyrrolidine, 2-(2-aminoethyl)-1-methylpyrrolidine, N,N-diethylethylenediamine, N,N-dimethylethylenediamine, N,N-dibutylethylenediamine, N,N-diethyl-1,3-diaminopropane, N,N-dimethyl-1,3-diaminopropane, N,N,N'-trimethylethylenediamine, N,N-dimethyl-N'-ethylethylenediamine, N,N-diethyl-N'-methylethylenediamine, N,N,N'-triethylethylenediamine, 3-dimethylaminopropylamine, 3-diethylaminopropylamine, 3-dibutylaminopropylamine, N,N,N'-trimethyl-1,3-propanediamine,N,N,2,2-tetramethyl-1,3-propanediamine, 2-amino-5-diethylaminopentane, N,N,N',N'-tetraethyldiethylenetriamine, 3,3'-diamino-N-methyldipropylamine, 3,3'-iminobis(N,N-dimethylpropylamine), or combinations thereof. When the foregoing compounds are quaternized, the resulting nitrogen-containing compound includes a quaternary ammonium amide salt.

In some embodiments the nitrogen-containing compounds are derived from N,N-dimethyl-1,3-diaminopropane, N,N-diethyl-1,3-diaminopropane, N,N-dimethylethylenediamine, N,N-diethylethylenediamine, N,N-dibutylethylenediamine, or combinations thereof.

The compounds having an oxygen or nitrogen atom may further include aminoalkyl substituted heterocyclic compounds such as 1-(3-aminopropyl)imidazole and 4-(3-aminopropyl)morpholine, 1-(2-aminoethyl)piperidine, 3,3-diamino-N-methyldipropylamine, and 3,3'-iminobis(N,N-dimethylpropylamine).

Another type of compound having an oxygen or nitrogen atom capable of condensing with the intermediates include alkanolamines including but not limited to triethanolamine, trimethanolamine, N,N-dimethylaminopropanol, N,N-diethylaminopropanol, N,N-diethylaminobutanol, Triisopropanolamine, 1-[2-hydroxyethyl]piperidine, 2-[2-(dimethylamine)ethoxy]-ethanol, N-ethyldiethanolamine, N-methyldiethanol amine, N-butyldiethanolamine, N,N-diethylaminoethanol, N,N-dimethyl aminoethanol, 2-dimethylamino-2-methyl-1-propanol. In embodiments where alkanolamines and/or similar materials are used and the compound is quaternized, the resulting additive includes a quaternary ammonium ester salt.

In one embodiment the compound having an oxygen or nitrogen atom is Triisopropanolamine, 1-[2-hydroxyethyl]piperidine, 2-[2-(dimethyl amine) ethoxy]-ethanol, N-ethyldiethanolamine, N-methyldiethanolamine, N-butyldiethanolamine, N,N-diethylamino ethanol, N,N-dimethylamino ethanol, 2-dimethylamino-2-methyl-1-propanol, or combinations thereof.

In another embodiment, suitable compounds having an oxygen or nitrogen atom can also include those of the formula

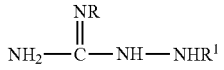

wherein R is selected from the group consisting of hydrogen and a hydrocarbyl group containing from about 1 to about 15 carbon atoms, and $R^1$ is selected from the group consisting of hydrogen and a hydrocarbyl group containing from about 1 to about 20 carbon atoms. Accordingly, the compounds having an oxygen or nitrogen atom may be chosen from the inorganic salts of guanidines, such as the halide, carbonate, nitrate, phosphate, and orthophosphate salts of guanidines. The term "guanidines" refers to guanidine and guanidine derivatives, such as aminoguanidine. In one embodiment, the guanidine compound for the preparation of the additive is aminoguanidine bicarbonate. Aminoguanidine bicarbonates are readily obtainable from commercial sources, or can be prepared in a well-known manner.

The resultant nitrogen-containing compounds are prepared by reacting the intermediates with the compounds containing an oxygen or nitrogen atom. The nitrogen-containing compound can further be quaternized by reacting the nitrogen-containing compound with a quaternizing agent.

Suitable quaternizing agents for preparing a quaternary ammonium salt of any of the nitrogen-containing compounds described above include dialkyl sulfates, benzyl halides, hydrocarbyl substituted carbonates, hydrocarbyl epoxides used in combination with an acid, esters of polycarboxylic acids, or mixtures thereof.

In one embodiment the quaternizing agent includes halides: such as, chloride, iodide or bromide; hydroxides; sulphonates; alkyl sulphates, such as, dimethyl sulphate; sultones; phosphates; $C_{1-12}$ alkylphosphates; di-$C_{1-12}$ alkylphosphates; borates; $C_{1-12}$ alkylborates; nitrites; nitrates; carbonates; bicarbonates; alkanoates; O,O-di-$C_{1-12}$ alkyldithiophosphates; or mixtures thereof.

In one embodiment the quaternizing agent may be: a dialkyl sulphate such as dimethyl sulphate; N-oxides; sultones such as propane or butane sultone; alkyl, acyl or aralkyl halides such as methyl and ethyl chloride, bromide or iodide or benzyl chloride; hydrocarbyl (or alkyl) substituted carbonates; or combinations thereof. If the aralkyl halide is benzyl chloride, the aromatic ring is optionally further substituted with alkyl or alkenyl groups.

The hydrocarbyl (or alkyl) groups of the hydrocarbyl substituted carbonates may contain 1 to 50, 1 to 20, 1 to 10 or 1 to 5, or 1 to 3 carbon atoms per group. In one embodiment the hydrocarbyl substituted carbonates contain two hydrocarbyl groups that may be the same or different. Examples of suitable hydrocarbyl substituted carbonates include dimethyl or diethyl carbonate.

In another embodiment the quaternizing agent can be a hydrocarbyl epoxides, as represented by the following formula:

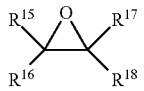

(XIV)

wherein $R^{15}$, $R^{16}$, $R^{17}$ and $R^{18}$ can be independently H or a $C_{1-50}$ hydrocarbyl group. Examples of suitable hydrocarbyl epoxides include: styrene oxide, ethylene oxide, propylene oxide, butylene oxide, stilbene oxide, $C_{2-50}$ epoxides, or combinations thereof.

In another embodiment the quaternizing agent can be an ester of a carboxylic acid capable of reacting with a tertiary amine to form a quaternary ammonium salt, or an ester of a polycarboxylic acid. In a general sense such materials may be described as compounds having the structure:

$$R^{19}—C(=O)—O—R^{20} \quad (XV)$$

where R19 is an optionally substituted alkyl, alkenyl, aryl or alkylaryl group and R20 is a hydrocarbyl group containing from 1 to 22 carbon atoms.

Suitable ester compounds include esters of carboxylic acids having a pKa of 3.5 or less. In some embodiments the compound is an ester of a carboxylic acid selected from a substituted aromatic carboxylic acid, an a-hydroxycarboxylic acid and a polycarboxylic acid. In some embodiments the compound is an ester of a substituted aromatic carboxylic acid and thus $R^{19}$ is a substituted aryl group. R may be a substituted aryl group having 6 to 10 carbon atoms, a phenyl group, or a naphthyl group. R may be suitably substituted with one or more groups selected from carboalkoxy, nitro, cyano, hydroxy, SR' or NR'R" where each of R' and R" may independently be hydrogen, or an optionally substituted alkyl, alkenyl, aryl or carboalkoxy groups. In some embodiments R' and R" are each independently hydrogen or an optionally substituted alkyl group containing from 1 to 22, 1 to 16, 1 to 10, or even 1 to 4 carbon atoms.

In some embodiments, $R^{19}$ in the formula above is an aryl group substituted with one or more groups selected from hydroxyl, carboalkoxy, nitro, cyano and $NH^2$. $R^{19}$ may be a poly-substituted aryl group, for example trihydroxyphenyl, but may also be a mono-substituted aryl group, for example an ortho substituted aryl group. $R^{19}$ may be substituted with a group selected from OH, $NH_2$, $NO_2$, or COOMe. Suitably $R^{19}$ is a hydroxy substituted aryl group. In some embodiments, $R^{19}$ is a 2-hydroxyphenyl group. $R^{20}$ may be an alkyl or alkylaryl group, for example an alkyl or alkylaryl group containing from 1 to 16 carbon atoms, or from 1 to 10, or 1 to 8 carbon atoms. $R^{20}$ may be methyl, ethyl, propyl, butyl, pentyl, benzyl or an isomer thereof. In some embodiments $R^{20}$ is benzyl or methyl. In some embodiments the quaternizing agent is methyl salicylate.

In some embodiments the quaternizing agent is an ester of an alpha-hydroxycarboxylic acid. Compounds of this type suitable for use herein are described in EP 1254889. Examples of suitable compounds which contain the residue of an alpha-hydroxycarboxylic acid include (i) methyl-, ethyl-, propyl-, butyl-, pentyl-, hexyl-, benzyl-, phenyl-, and allyl esters of 2-hydroxyisobutyric acid; (ii) methyl-, ethyl-, propyl-, butyl-, pentyl-, hexyl-, benzyl-, phenyl-, and allyl esters of 2-hydroxy-2-methylbutyric acid; (iii) methyl-, ethyl-, propyl-, butyl-, pentyl-, hexyl-, benzyl-, phenyl-, and allyl esters of 2-hydroxy-2-ethylbutyric acid; (iv) methyl-, ethyl-, propyl-, butyl-, pentyl-, hexyl-, benzyl-, phenyl-, and allyl esters of lactic acid; and (v) methyl-, ethyl-, propyl-, butyl-, pentyl-, hexyl-, allyl-, benzyl-, and phenyl esters of glycolic acid. In some embodiments the quaternizing agent comprises methyl 2-hydroxyisobutyrate.

In some embodiments the quaternizing agent comprises an ester of a polycarboxylic acid. In this definition we mean to include dicarboxylic acids and carboxylic acids having more than 2 acidic moieties. In some embodiments the esters are alkyl esters with alkyl groups that contain from 1 to 4 carbon atoms. Suitable example include diesters of oxalic acid, diesters of phthalic acid, diesters of maleic acid, diesters of malonic acid or diesters or triesters of citric acid.

In some embodiments the quaternizing agent is an ester of a carboxylic acid having a pKa of less than 3.5. In such embodiments in which the compound includes more than one acid group, we mean to refer to the first dissociation constant. The quaternizing agent may be selected from an ester of a carboxylic acid selected from one or more of oxalic acid, phthalic acid, salicylic acid, maleic acid, malonic acid, citric acid, nitrobenzoic acid, aminobenzoic acid and 2, 4, 6-trihydroxybenzoic acid. In some embodiments the quaternizing agent includes dimethyl oxalate, methyl 2-nitrobenzoate and methyl salicylate.

Any of the quaternizing agents described above, including the hydrocarbyl epoxides, may be used in combination with an acid. Suitable acids include carboxylic acids, such as acetic acid, propionic acid, 2-ethylhexanoic acid, and the like. In some embodiments, for example when the intermediate used to prepare the nitrogen-containing compound is a dicarboxylic acylating agent, no separate acid component is needed. In such embodiments, the nitrogen-containing compound may be prepared by combining reactants which are essentially free to free of an acid component, such as acetic acid, and rely on the acid group provided by the intermediate instead.

In certain embodiments the molar ratio of nitrogen-containing compound to quaternizing agent is 1:0.1 to 2, or 1:1 to 1.5, or 1:1 to 1.3.

In some embodiments the quaternary ammonium salt of the nitrogen-containing compound includes the reaction product of: (i) a compound comprising at least one tertiary amino group; and (ii) a quaternizing agent suitable for converting the tertiary amino group of compound (i) to a quaternary nitrogen, where component (i), the compound comprising at least one tertiary amino group, comprises: (a) the condensation product of a hydrocarbyl-substituted acylating agent and a compound having an oxygen or nitrogen atom capable of condensing the acylating agent wherein the condensation product has at least one tertiary amino group.

In some embodiments the hydrocarbyl-substituted acylating agent may be polyisobutylene succinic anhydride and the compound having an oxygen or nitrogen atom capable of condensing with said acylating agent may be dimethylaminopropylamine, dimethyl ethanolamine, diethyl ethanolamine, N-methyl-1,3-diaminopropane, N,N-dimethylaminopropylamine, N,N-diethyl-aminopropylamine, N,N-dimethyl-aminoethylamine, diethylenetriamine, dipropylenetriamine, dibutylenetriamine, triethylenetetramine, tetraethylenepentamine, pentaethylenehex amine, hexamethylenetetramine, and bis(hexamethylene) triamine.

In some embodiments the quaternary ammonium salt comprises a cation represented by the following formula:

(XVI)

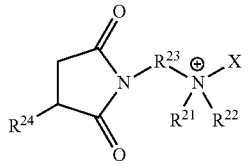

wherein: R21 is a hydrocarbyl group containing from 1 to 3 carbon atoms; R22 is a hydrocarbyl group containing from 1 to 3 carbon atoms; R23 is a hydrocarbylene group containing from 1 to 3 carbon atoms; R24 is a hydrocarbyl group containing from 7 to 36 carbon atoms; and X is a group derived from the quaternizing agent.

The concentrated multi-functional additive package can include about 10 to about 90% by weight of a blend of at least one oxygen-containing compound, as described above, and at least one nitrogen-containing compound, as described above. The blend can also be included in the multi-functional additive package at about 15 to about 70% by weight, or about 20 to about 50% by weight. The blend of at least one oxygen-containing compound and at least one nitrogen-containing compound can be included in a ratio of about 1:0.1 to about 1:10, on a molar basis, of the oxygen-containing compound to the nitrogen-containing compound. The ratio of the blend can also be from about 1:0.5 to about 1:8, or from about 1:1 to about 1:6.

Lubricity Improving Compound

The concentrated multi-functional additive package can include at least one lubricity improving compound.

Lubricity aids include glycerol monooleate, sorbitan monooleate and the like. Lubricity additives also include additives with an acid functionality as well as the ester and amide derivatives thereof, where suitable agents often contain from 8 to 50 carbon atoms.

The lubricity improver can include oil soluble hydrocarbyl substituted mono- and polycarboxylic acids, wherein the hydrocarbyl substituent has up to about 24 carbon atoms per molecule, and in one embodiment about 8 to about 24 carbon atoms, and in one embodiment about 8 to about 22 carbon atoms per molecule, and in one embodiment about 10 to about 18 carbon atoms. These include fatty acids and mixtures thereof having up to about 24 carbon atoms, and especially fatty acids or mixtures thereof having about 10 to about 18 carbon atoms. Examples include linear or branched, saturated and unsaturated fatty acids, such as palmitic acid, lauric acid, stearic acid, oleic acid, myristic acid, linoleic acid, linolenic acid, decenoic acid, octadecenoic acid, octadecadienoic acid, 2-ethylhexanoic acid, isooctanoic acid, isodecanoic acid, neodecanoic acid, tall oil acid, and the like. In one embodiment, the lubricity improver is cis-9-octadecenoic acid, 9,12-octadecadienoic acid, tall oil acid or a mixture thereof. The acid producing compounds that are useful include the corresponding anhydrides. When the lubricity improver is a polycarboxylic acid, partial esters of such polycarboxylic acids can be used. Examples of esters include methyl and ethyl esters and glycerol esters such as glycerol monooleate and dioleate.

The lubricity improver can include hydrocarbyl substituted succinic acids, anhydrides and amides. These can be represented by the formulae:

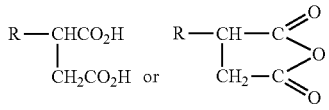

wherein, R is a hydrocarbyl group of about 8 to about 24 carbon atoms, and in one embodiment about 8 to about 20 carbon atoms, and in one embodiment about 10 to about 18 carbon atoms. These include tetrapropenyl-substituted succinic acid and anhydride. The production of such substituted succinic acids and their derivatives via alkylation of maleic acid or its derivatives with a halohydrocarbon is well known to those of skill in the art and need not be discussed in detail herein.

Partial esters of the succinic acids or anhydrides of the above formulae can be prepared simply by the reaction of the acid or anhydride with an alcohol or phenolic compound. Particularly useful are the lower alkyl and alkenyl alcohols such as methanol, ethanol, allyl alcohol, propanol, cyclohexanol, etc. Esterification reactions are usually promoted by the use of alkaline catalysts such as sodium hydroxide or alkoxide, or an acidic catalyst such as sulfuric acid or toluene sulfonic acid.

Amides of the succinic acids can be prepared by the reaction of the acid with an amine. The amine may be a monoamine or a polyamine (such as a diamine, triamine, tetramine or pentamine). The amine can be a primary, secondary or tertiary amine. The primary and secondary monoamines and polyamines are characterized by the presence within their structure of at least one HN<group. Therefore, they have at least one primary (i.e., $H_2N$—) or secondary amine (i.e., 1 HN<) group. Useful amines include primary amines, such as hexyl amine, octyl amine, decyl amine, lauryl amine, myristyl amine, cetyl amine, stearyl amine, oleyl amine, and tallow amine. Specific examples of secondary monoamines include dioctylamine, N-octyl-N-decylamine, didecylamine, N-nonyl-N-decylamine, didecylamine, N-decyl-N-dodecylamine, and dioctadecylamine. Specific examples of diamines include N-aminopropyldecyl amine, N-propyllauryl amine, N-aminopropylmyristyl amine, N-aminopropylcetyl amine, N-aminopropylstearyl amine, and N-aminopropyltallow amine. The triamines include for example N-decyldipropylene triamine, laurtyldipropylene triamine, N-myristyldipropylene triamine, N-cetyldipropylene triamine, N-stearyldipropylene triamine, and N-tallowdipropylene triamine. The tetramines include N-lauryltripropylene tetramine, N-myristyltripropylene tetramine, N-cetyltripropylene tetramine, N-stearyltrirpylene tetramine, and N-tallow-tripropylene tetramine. The pentamines include N-lauryltetrapropylene tetramine, N-myristyltetrapropylene tetramine, N-stearyltetrapropylene tetramine, and N-tallow-tetrapropylene tetramine.

Solvent

The concentrated multi-functional additive package can include at least one solvent. The solvents suitable for use in the present invention include hydrocarbon solvents that provide for the additive composition's compatibility and/or homogeneity and to facilitate their handling and transfer and may include a fuel as described below. The solvent can be an aliphatic hydrocarbon, an aromatic hydrocarbon, an oxygen-containing composition, or a mixture thereof. In some embodiments the flash point of the solvent is generally about 25° C. or higher. In some embodiments the hydrocarbon solvent is an aromatic naphtha having a flash point above 62° C. or an aromatic naphtha having a flash point of 40° C. or a kerosene with a 16% aromatic content having a flash point above 62° C.

Aliphatic hydrocarbons include various naphtha and kerosene boiling point fractions that have a majority of aliphatic components. Aromatic hydrocarbons include benzene, toluene, xylenes and various naphtha and kerosene boiling point fractions that have a majority of aromatic components. Alcohols can be aliphatic alcohols having about 2 to 10 or 15 or 18 carbon atoms and include ethanol, 1-propanol, isopropyl alcohol, 1-butanol, isobutyl alcohol, amyl alcohol, 2-ethyl hexanol, octanol, 2-butyl-octanol, 2-hexyl-decanol, 2-octyl-dodecanol, 2-decyl-tetradecanol, 2-dodecyl-hexadecanol, and 2-methyl-1-butanol.

Compatibilizer Mixture

The concentrated multi-functional additive package can optionally include at least one compatibilizer mixture.

The compatibilizer mixture can contain a mixture of a 1 to 10 carbon atom-alcohol and low molecular weight acylated nitrogen compound (i.e., compatibilizer). The acylated nitrogen compound can the reaction product of alkyl succinic anhydride and an alkanolamine present in a ratio of 1:10 to 10:1, 1:5 to 5:1, 3:5 to 5:3, 1:2 to 2:1, or 1:1.

The $C_{1-10}$ or $C_{1-18}$ alcohol of the compatibilizer mixture can be saturated, unsaturated, branched, linear, cyclo or mixtures thereof. The hydroxyl group of the $C_{1-10}$ or $C_{1-18}$ alcohol can be primary, secondary, tertiary or mixtures thereof. Additionally, the $C_{1-10}$ or $C_{1-18}$ alcohol can be a mono, di, or polyol. Examples of the alcohols of the compatilizer can include cis-2-buten-1-ol, 2-butoxyethanol, 2-ethylhexanol, 3-heptanol, 3-pentanol, 3,3-dimethyl-1-butanol, 2,5-hexanediol, 2-hexanol, 1-hexanol, 1-heptanol, 2-octanol, trans-2-buten-1-ol, 4-methyl-2-pentanol, 2-methyl-1-pentanol, isodecyl alcohol, isooctyl alcohol, octanol, 2-butyl-octanol, 2-hexyl-decanol, 2-octyl-dodecanol, 2-decyl-tetradecanol, 2-dodecyl-hexadecanol, or mixtures thereof.

In certain embodiments, the $C_{1-10}$ alcohol of the compatibilizer mixture is added at a level, not to exceed 50% by weight of the compatibilizer mixture, requisite to achieve a kinematic viscosity of the multi-functional additive package of around 25 cSt at 40° C., or anywhere between 10 and 60 cSt at 40° C., and less than 3000 cSt, or 2000, or 1500 or 500 cSt at −30° C. as measured according to ASTM D445. In some embodiments the $C_{1-10}$ alcohol of the compatibilizer mixture can be added at a level, not to exceed 50% by weight of the compatibilizer mixture, requisite to achieve a kinematic viscosity of around 25 cSt at 40° C. and around 1400 or 1300 cSt at −30° C. as measured according to ASTM D445.

The acylated nitrogen compound of the compatibilizer mixture is the reaction product of an alkyl succinic anhydride or its acid or ester derivative and an alkanolamine. The alkyl group of the alkyl succinic anhydride can be a hydrocarbyl group containing from about 4 to about 18 carbon atoms; from about 6 to about 18 carbon atoms, from about 9 to about 18 carbon atoms and particularly from about 12 to about 18 carbon atoms. The alkyl group of the alkyl succinic anhydride can be saturated, unsaturated, branched, linear or mixtures thereof.

The alkyl succinic anhydride can be the reaction product of a branched or linear olefin having about 4 to about 18 carbon atoms; from about 6 to about 18 carbon atoms, from about 9 to about 18 carbon atoms and particularly from about 12 to about 18 carbon atoms and maleic anhydride. This reaction is well known to those skilled in the art.

The alkanolamine component of the acylated nitrogen compound can be amino alcohols, such as, an ethanolamine (including mono, di and tri ethanolamines), or a propanol amines (including mono, di and tri ethanolamines) in which nitrogen is attached directly to the carbon of the alkyl alcohol. Examples of the alkanolamine component of the acylated nitrogen compounds can include: monoethanolamine, triethanolamine, methylethanolamine, methyldiethanolamine, dimethylethanolamine, diethylethanolamine, dibutylethanolamine, monoisopropanolamine, diisopropanolamine, triisopropanolamine. The examples of these alkanolamines are well known to those skilled in the art.

The reaction products of the alkyl succinic anhydride or its acid or ester derivative and the alkanolamine include amides, imides, esters, amine salts, ester-amides, ester-amine salts, amide-amine salts, acid-amides, acid-esters and, mixtures thereof. The reaction and the resulting products of the alkyl succinic anhydride and the alkanolamine are readily known to those skilled in the art.

Antioxidant

The concentrated multi-functional additive package can include at least one anti-oxidant.

Suitable antioxidants include amine antioxidants, sterically hindered phenolic antioxidants, polyhydroxy phenolic antioxidants, derivatives and mixtures thereof.

In one embodiment amine antioxidants can include oil-soluble aromatic secondary amines; aromatic secondary monoamines; and others such as tertiary aliphatic amines. In another embodiment, suitable aromatic secondary monoamines include diphenylamine, alkyl diphenylamines containing 1 to 2 alkyl substituents each having up to about 16 carbon atoms, phenyl-alpha-naphthylamine, alkyl- or aralkylsubstituted phenyl-alpha-naphthylamine containing one or two alkyl or aralkyl groups each having up to about 16 carbon atoms, alkyl- or aralkyl-substituted phenyl-alpha-naphthylamine containing one or two alkyl or aralkyl groups each having up to about 16 carbon atoms, alkylated p-phenylene diamines available from Goodyear, under the trade name "Wingstay 100," and from Chemtura, and similar compounds.

In yet another embodiment, useful amines include alkylated (p)-phenylene diamines, such as, N,N'-di-isopropyl-p-phenylenediamine; N,N'-di-sec-butyl-p-phenylenediamine; N,N'-bis(1,4-dimethylpentyl)-p-phenylenediamine; N,N'-bis(1-ethyl-3-methylpentyl)-p-phenylenediamine; N,N'-bis(1-methylheptyl)-p-phenylenediamine; N,N'-dicyclohexyl-p-phenylenediamine; N,N'-di(2-naphthyl)-p-phenylenediamine; 4-(p-toluenesulfonamido)

diphenylamine; N,N'-dimethyl-N,N'-di-sec-butyl-p-phenylenediamine; 4-n-butylaminophenol; 4-butyrylaminophenol; 4-nonanoylaminophenol; 4-dodecanoylaminophenol; 4-octadecanoylaminophenol; 2,6-di-tert-butyl-4-dimethylaminomethylphenol; 2,4'-diaminodiphenylmethane; 4,4'-diaminodiphenylmethane; N,N,N',N'-tetramethyl-4,4'-diaminodiphenylmethane; 1,2-di[(2-methylphenyl)amino]ethane; 1,2-di(phenylamino)propane (o-tolyl)biguanide di[4-(1',3'-dimethylbutyl)phenyl]amine; 2,3-dihydro-3,3-dimethyl-4H-1,4-benzothiazine; phenothiazine; N-allylphenothiazine, N,N'-dioctyl-p-phenylenediamine; N,N'-di-sec-butyl-o-phenylenediamine; triethylenetetraamine-di-(mononononylphenolate); N-sec-butyl, N'-phenyl-o-phenylenediamine and mixture thereof.

Other useful amine antioxidants are the reaction products of a diarylamine and an aliphatic ketone. The diarylamine aliphatic ketone reaction products which are useful herein are disclosed in U.S. Pat. Nos. 1,906,935; 1,975,167; 2,002,642 and 2,562,802. Briefly described, these products are obtained by reacting a diarylamine, preferably a diphenylamine, which may or may not possess one or more substituents on either aryl group with an aliphatic ketone, preferably acetone, in the presence of a suitable catalyst. In addition to diphenylamine, other suitable diarylamine reactants include dinaphthyl amines, p-nitrodiphenylamine, 2,4-dinitrodiphenylamine, p-aminodiphenylamine; p-hydroxydiphenylamine, etc. Besides acetone, other useful ketone reactants include methylethylketone, diethylketone, monochloroacetone, dichloroacetone, and the like.

In one embodiment, phenolic antioxidants include, e.g., sterically hindered phenolic antioxidants, such as, ortho-alkylated phenolic compounds which include 2,4-di-tertbutylphenol, 2,6-di-tertbutylphenol, 4-methyl-2,6-di-tert-butylphenol, 2,4,6-tri-tertbutylphenol, 2-tert-butylphenol, 2,6-diisopropylphenol, 2-methyl-6-tert-butylphenol, 2,4-dimethyl-6-tert-butylphenol, 4-(N,N-dimethylaminomethyl)-2,6-di-tert-butylphenol, 4-ethyl-2,6-di-tertbutylphenol, 2-methyl-6-styrylphenol, 2,6-di-styryl-4-nonylphenol, and their analogs and homologs. One or more partially sulfurized phenolic compounds as described in U.S. Pat. No. 6,096,695, the disclosure of which is incorporated herein by reference; methylene-bridged alkylphenols as described in U.S. Pat. No. 3,211,652, the disclosure of which is incorporated herein by reference. In another embodiment of the invention, suitable phenolic antioxidants include alkylated monophenols such as 2-tert-butyl-4,6-dimethylphenol; 2,6-di-tert-butyl-4-ethylphenol; 2,6-di-tert-butyl-4-n-butylphenol; 2,6-di-tert-butyl-4-iso-butylphenol; 2,6-di-cyclopentyl-4-methylphenol; 2-(.alpha.-methylcyclohexyl)-4,6-dimethylphenol; 2,6-di-octadecyl-4-methylphenol; 2,4,6-tri-cyclohexylphenol; 2,6-di-tert-butyl-4-methoxymethylphenol, 3-tert butyl-4-hydroxyanisole (BHA); and o-tert-butylphenol. Alkylated hydroquinones, such as 2,6-di-tert-butyl-4-methoxyphenol; 2,5-di-tert-butylhydroquinone; 2,5-di-tert-amylhydroquinone; and 2,6-diphenyl-4-octadecyloxyphenol tert-butyl hydroquinone (TBHQ). Hydroxylated thiodiphenyl ethers such as 2,2'-thio-bis(6-tert-butyl-4-methylphenol); and 2,2'thio-bis(4-octylphenol). Alkylidene bisphenols such as 2,2'-methylene-bis(6-tert-butyl-4-methylphenol); 2,2'-methylene-bis(6-tert-butyl-4-ethylphenol); 2,2'-methylene-bis[4-methyl-6-(.alpha.-methylcyclohexyl)phenol]; 2,2'-methylene-bis(4-methyl-6-cyclohexylphenol); 2,2'-methylene-bis(6-nonyl-4-methylphenol); 2,2'-methylene-bis(4,6-di-tert-butylphenol); 2,2'-ethylidene-bis(4,6-di-tert-butylphenol); 2,2'-ethylidene-bis(6-tert-butyl-4-isobutylphenol or -5-isobutylphenol); 2,2'-methylene-bis[6-(.alpha.-methylbenzyl)-4-nonylphenol]; 2,2'-methylene-bis[6-(.alpha.,.alpha.-dimethylbenzyl)-4-nonylphenol]; 4,4'-methylene-bis(2,6-di-tert-butylphenol); 4,4'-methylene-bis(6-tert-butyl-2-methylphenol); 1,1-bis(5-tert-butyl-4-hydroxy-2-methylphenyl)butane; 2,6-di(3-tert-butyl-5-methyl-2-hydroxybenzyl)-4-methylphenol; 1,1,3-tris(5-tert-butyl-4-hydroxy-2-methylphenyl)-3-n-dodecylmercaptobutane; ethylene glycol bis[3,3-bis(3'-tert-butyl-4'-hydroxyphenyl)butyrate]; bis(3-tert-butyl-4-hydroxy-5-methylphenyl)dicyclopentadiene; and bis[2-(3'-tert-butyl-2'-hydroxy-5'-methylbenzyl)-6-tert-butyl-4-methylphenyl] terephthalate. Benzyl compounds such as 1,3,5-tris(3,5-di-tert-butyl-4-hydroxybenzyl)-2,4,6-trimethylbenzene; bis(3,5-di-tert-butyl-4-hydroxybenzyl)sulfide; bis(4-tert-butyl-3-hydroxy-2,6-dimethylbenzyl)dithiol terephthalate; 1,3,5-tris(3,5-di-tert-butyl-4-hydroxybenzyl) isocyanurate; 1,3,5-tris(4-tert-butyl-3-hydroxy-2,6-dimethylbenzyl)isocyanurate; dioctadecyl 3,5-di-tert-butyl-4-hydroxybenzylphosphonate; and monoethyl 3,5-di-tert-butyl-4-hydroxybenzylphosphonate calcium salt. Acylaminophenols such as 4-hydroxylauranilide; 4-hydroxystearanilide; 2,4-bis-octylmercapto-6-(3,5-di-tert-butyl-4-hydroxyanilino)-s-triazine; and octyl N-(3,5-di-tert-butyl-4-hydroxyphenyl)carbamate. In addition, naturally occurring antioxidants such as, for example, vitamin E, ascorbic and citric acid.

Suitable polyhydroxy phenolic antioxidants include esters of gallic acid, such as propyl gallate, octyl gallate, and dodecyl gallate; nordihydroguaiaretic acid (2,3-dimethyl-1,4-bis(3,4-dihydroxyphenyl)butane); 2,4,5-trihydroxybutyrophenone; p-tert-butyl cathechol, cathechol, and the like.

Fuel Compositions

Fuels

The fuel compositions utilized comprise the multi-functional additive described herein and a liquid fuel, and is useful in fueling an internal combustion engine. The fuel compositions may also include one or more additional performance additives.

The fuel compositions can comprise a fuel which is liquid at room temperature and is useful in fueling an engine. The fuel is normally a liquid at ambient conditions e.g., room temperature (20 to 30° C.). The fuel can be a hydrocarbon fuel, a nonhydrocarbon fuel, or a mixture thereof.

The hydrocarbon fuel can be a petroleum distillate to include a gasoline as defined by EN228 or ASTM specification D4814, or a diesel fuel as defined by EN590 or ASTM specification D975. In an embodiment of the invention the fuel is a gasoline, and in other embodiments the fuel is a leaded gasoline, or a nonleaded gasoline. In another embodiment of this invention the fuel is a diesel fuel. The hydrocarbon fuel can be a hydrocarbon prepared by a gas to liquid process to include for example hydrocarbons prepared by a process such as the Fischer-Tropsch process.

The nonhydrocarbon fuel can be an oxygen containing composition, often referred to as an oxygenate, to include an alcohol, an ether, a ketone, an ester of a carboxylic acid, a nitroalkane, or a mixture thereof. The nonhydrocarbon fuel can include for example methanol, ethanol, methyl t-butyl ether, methyl ethyl ketone, transesterified oils and/or fats from plants and animals such as rapeseed methyl ester and soybean methyl ester, and nitromethane.

Mixtures of hydrocarbon and nonhydrocarbon fuels can include for example gasoline and methanol and/or ethanol, diesel fuel and ethanol, and diesel fuel and a transesterified plant oil such as rapeseed methyl ester. In an embodiment of the fuel composition the liquid fuel is an emulsion of water in a hydrocarbon fuel, a nonhydrocarbon fuel, or a mixture thereof.

In several embodiments of the fuel composition the fuel can have a sulphur content on a weight basis that is 10,000 or 5000 ppm or less, 1000 ppm or less, 300 ppm or less, 200 ppm or less, 30 ppm or less, or 10 ppm or less. In another embodiment the fuel can have a sulphur content on a weight basis of 1 to 100 ppm. In one embodiment the fuel contains about 0 ppm to about 1000 ppm, about 0 to about 500 ppm, about 0 to about 100 ppm, about 0 to about 50 ppm, about 0 to about 25 ppm, about 0 to about 10 ppm, or about 0 to 5 ppm of alkali metals, alkaline earth metals, transition metals or mixtures thereof. In another embodiment the fuel contains 1 to 10 ppm by weight of alkali metals, alkaline earth metals, transition metals or mixtures thereof. It is well known in the art that a fuel containing alkali metals, alkaline earth metals, transition metals or mixtures thereof have a greater tendency to form deposits and therefore foul or plug common rail injectors.

The fuel of the fuel composition is present in a major amount that is generally greater than 50 percent by weight, and in other embodiments is present at greater than 90 percent by weight, greater than 95 percent by weight, greater than 99.5 percent by weight, or greater than 99.8 percent by weight.

The multi-functional additive package can be dosed into the fuel compositions from about 100 to about 500 ppm by weight, and in other instances can be present from 150 to about 450 ppm by weight, or even from about 200 or 250 to about 400 ppm by weight.

By using a concentrated multi-functional additive package in the fuel composition, the engine is protected over time whatever the fuel quality used. The system can deliver additives for about 15,000 km before fuel filter change due to the packages being highly concentrated. The protection is maintained over a large range of temperatures as the products remain liquid at low temperatures and show limited viscosity changes over the temperature range (1200 cSt at −30° C. vs. 10 cSt at +70° C.).

The multi-functional additive package can overcome the conflicting problems of making a highly concentrated package having a pumpable viscosity (i.e., ~25 cSt at 40° C.) and which is stable over a large temperature range.

The multi-functional additive package can be employed in an internal combustion engine. There is provided a method for operating an internal combustion engine comprising delivering to said engine a fuel and the multi-functional additive package, and operating the engine.

In an embodiment, the multi-functional additive package can be combined with the fuel by direct addition. In such cases, the additized fuel containing the multi-functional additive package may be contained in a fuel tank, and transmitted to the engine where it is combusted. The additized fuel can also be used for operating an engine equipped with an exhaust system with a particulate filter or a catalyzed soot filter.

In another embodiment, the multi-functional additive package can be maintained on-board the apparatus driven by the engine (for example an automobile, a bus, a truck, etc.) in a tank with the multi-functional additive package separated from the fuel. In these embodiments, the multi-functional additive package can be combined or mixed with the fuel during the operation of the engine. Like other techniques, it is also possible to add the multi-functional additive package to the fuel and/or to the fuel tank, or at the fuel terminal before filling the tank of the motor-driven vehicle.

Suitable internal combustion engines include spark ignition engines and compression ignition engines; 2 stroke or 4 stroke cycles; direct injection, indirect injection, injection by a nozzle and a carburetor; systems with a rail injector and a pump-injector; engines for lightweight vehicles (for example a passenger vehicle) and heavy duty vehicles (for example a commercial truck); and engines which operate with fuels of the hydrocarbon type and of the type other than a hydrocarbon and mixtures thereof. The engines may be part of integrated emission systems containing elements such as EGR systems; a post-treatment including a three-way catalyst, an oxidation catalyst, NOx absorbers and catalysts, catalyzed and non-catalyzed particle traps; variable distribution; and synchronization of the injection and a configuration of the flow rate.

As used herein, the term "condensation product" is intended to encompass esters, amides, imides and other such materials that may be prepared by a condensation reaction of an acid or a reactive equivalent of an acid (e.g., an acid halide, anhydride, or ester) with an alcohol or amine, irrespective of whether a condensation reaction is actually performed to lead directly to the product. Thus, for example, a particular ester may be prepared by a transesterification reaction rather than directly by a condensation reaction. The resulting product is still considered a condensation product.

The amount of each chemical component described is presented exclusive of any solvent or diluent oil, which may be customarily present in the commercial material, that is, on an active chemical basis, unless otherwise indicated. However, unless otherwise indicated, each chemical or composition referred to herein should be interpreted as being a commercial grade material which may contain the isomers, by-products, derivatives, and other such materials which are normally understood to be present in the commercial grade.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring);

substituted hydrocarbon substituents, that is, substituents containing non-hydrocarbon groups which, in the context of this invention, do not alter the predominantly hydrocarbon nature of the substituent (e.g., halo (especially chloro and fluoro), hydroxy, alkoxy, mercapto, alkylmercapto, nitro, nitroso, and sulfoxy);

hetero substituents, that is, substituents which, while having a predominantly hydrocarbon character, in the context of this invention, contain other than carbon in a ring or chain otherwise composed of carbon atoms and encompass substituents as pyridyl, furyl, thienyl and imidazolyl. Heteroatoms include sulfur, oxygen, and nitrogen. In general, no more than two, or no more than one, non-hydrocarbon substituent will be present for every ten carbon atoms in the hydrocarbyl group; alternatively, there may be no non-hydrocarbon substituents in the hydrocarbyl group.

It is known that some of the materials described above may interact in the final formulation, so that the components of the final formulation may be different from those that are initially added. For instance, metal ions (of, e.g., a detergent) can migrate to other acidic or anionic sites of other molecules. The products formed thereby, including the products formed upon employing the composition of the present invention in its intended use, may not be susceptible of easy description. Nevertheless, all such modifications and reaction products are included within the scope of the present invention; the present invention encompasses the composition prepared by admixing the components described above.

EXAMPLES

Example 1

Example additive compositions are provided below. The nitrogen containing compound is a succinimide quaternary ammonium salt derived from dimethylaminopropylamine succinimide, 2-ethylhexyl alcohol and acetic acid and quaternized with propylene oxide. The oxygen containing compound is a polyisobutylene succinic anhydride derived from a 1000 number average molecular weight high vinylidene polyisobutylene and maleic anhydride. The first lubricity improver is a tall oil fatty acid (TOFA) and the second lubricity improver is a non-acidic lubricity improver, Perfad™ 3342 from Croda. The solvent is a commercially available mixture of hydrocarbon solvents.

| Components | Package 1 wt % | Package 2 wt % |
|---|---|---|
| Blend | 25.2% | 22.7% |
| Nitrogen Containing Compound | 18.6% | 16.7% |
| Oxygen Containing Compound | 6.6% | 6% |
| Lubricity Improver 1 | 37% | — |
| Lubricity Improver 2 | — | 23.3% |
| Solvent | 37.8% | 54% |

The performance of Packages 1 and 2 were tested and the results are shown below. The Packages would be expected to provide about a 3 to 7% decrease in power loss and prevent internal diesel injector deposits compared to a fuel without the additive.

| Physio-chemical properties | Test | Fuel | Package 1 | Package 2 |
|---|---|---|---|---|
| Storage stability at minus 30° C. | — | — | ~25% sediments after 4 weeks | No sediment after 8 weeks |
| Kinematic viscosity at minus 30° C. | ASTM D445_(−30) | — | 1380 cSt | 4482 cSt |
| Kinematic viscosity at 40° C. | ASTM D445_40 | — | 24 cSt | 37 cSt |

| Perfor-mance | Test | Fuel without additive | Fuel + 270 ppm wt/wt Package 1 | Fuel + 300 ppm wt/wt Package 2 |
|---|---|---|---|---|
| Corrosion inhibition | ASTM D665B-Argentinian fuel | 95% rust | 0% rust | 0% rust |
| Lubricity improve-ment | HFRR 335.02-Argentinian fuel | 627 μm | 477 μm | 426 μm |

Example 2

A mixture of low molecular weight alcohols as solvent and a compatibilizer mixture were added to Package 1 to achieve a compatibilizer mixture ("CM")/lubricity ("L") improver ratio in a ppm wt/wt as shown in the table below. The compatibilizer mixture employed was a low molecular weight acylated nitrogen compound derived from the reaction of an alkyl succinic anhydride and an alkanolamine, mixed with 2-EHL at the ratios shown ("C/A"). Storage stability and viscosity tests were run on the packages varying the amount of compatibilizer mixture, as shown in the table below.

| Products | Package 1-CM/L: 5.9/25 C/A: 1.5/4.4 | Package 1-CM/L: 6.8/25 C/A: 2.4/4.4 | Package 1-CM/L: 7.3/25 C/A: 3/4.4 | Package 1-CM/L: 7.9/25 C/A: 3.5/4.4 | Package 1-CM/L: 8.8/25 C/A: 4.4/4.4 |
|---|---|---|---|---|---|
| Storage stability at minus 30° C.-4 weeks | 7% sediments | 4% sediments | 2% sediments | 2% sediments | 0.5% sediments |
| Kinematic viscosity at 40° C. (D445_40) | 26 cSt | 27 cSt | 26 cSt | 30 cSt | 31 cSt |

It was found that increasing the compatibilizer mixture treat rate could help reducing the % sediments.

It has also been seen that removing alcohol from the compatibilizer mixture increases the % sediments and increases viscosity. The below example keeps the lubricity improver constant at 25 parts and modifies the ratio of compatibilizer/alcohol in the compatibilizer mixture on a ppm wt/wt ratio as shown.

| Products | Package 1 with 3/5 ratio | Package 1 with 3/0 |
|---|---|---|
| Storage stability at minus 30° C.-4 weeks | 4% sediments | 13% sediments |
| Kinematic viscosity at 40° C. | 25 cSt | 31 cSt |

Example 3

Further example packages are provided in the table below. The nitrogen containing compound is a succinimide quaternary ammonium salt derived from dimethylaminopropylamine succinimide, 2-ethylhexyl alcohol and acetic acid and quaternized with propylene oxide. The oxygen containing compound is a polyisobutylene succinic anhydride derived from a 1000 number average molecular weight high vinylidene polyisobutylene and maleic anhydride. The lubricity improver is a TOFA. The solvents are commercially available mixtures of low molecular weight alcohols and aliphatic hydrocarbons. Finally the antioxidant was 2,6-di-tert butyl phenol.

| Components | Package 3 wt % | Package 4 wt % |
|---|---|---|
| Blend | 24.3% | 17.9% |
| Nitrogen Containing Compound | 17.9% | 13.2% |
| Oxygen Containing Compound | 6.4% | 4.7% |
| Lubricity Improver | 30.4% | 22.4% |
| Compatiblizer Mixture | 8.9 | 6.6 |
| Alcohol | 5.3 | 4.0 |
| Compatibilizer | 3.6 | 2.6 |
| Solvent | 36.4 | 26.8 |
| Antioxidant | — | 26.3% |

| Performance | Test | Result-Fuel without additive | Result-Fuel + 280 ppm wt/wt package 1 | Result-Fuel + 380 ppm wt/wt package 2 |
|---|---|---|---|---|
| Corrosion inhibition | ASTM D665B-Argentinian fuel | 95% rust | 0% rust | 0% rust |
| Lubricity improvement | HFRR 335.02-Argentinian fuel | 627 μm | 482 μm | 482 μm |
| Oxidancy prevention | Rancimat EN14112-B20 fuel | 8.4 h | — | 15 h |

Storage stability tests were run for 8 weeks over a large range of temperatures to ensure the packages were stable. It was observed that Package 3 and 4 had an insignificant amount of deposits at −30° C. (<5% crystals), along with a viscosity of around 25 cSt at 40° C. and around 1300 cSt at −30° C.

Each of the documents referred to above is incorporated herein by reference, including any prior applications, whether or not specifically listed above, from which priority is claimed. The mention of any document is not an admission that such document qualifies as prior art or constitutes the general knowledge of the skilled person in any jurisdiction. Except in the Examples, or where otherwise explicitly indicated, all numerical quantities in this description specifying amounts of materials, reaction conditions, molecular weights, number of carbon atoms, and the like, are to be understood as modified by the word "about." It is to be understood that the upper and lower amount, range, and ratio limits set forth herein may be independently combined. Similarly, the ranges and amounts for each element of the invention can be used together with ranges or amounts for any of the other elements.

As used herein, the transitional term "comprising," which is synonymous with "including," "containing," or "characterized by," is inclusive or open-ended and does not exclude additional, un-recited elements or method steps. However, in each recitation of "comprising" herein, it is intended that the term also encompass, as alternative embodiments, the phrases "consisting essentially of" and "consisting of," where "consisting of" excludes any element or step not specified and "consisting essentially of" permits the inclusion of additional un-recited elements or steps that do not materially affect the essential or basic and novel characteristics of the composition or method under consideration.

While certain representative embodiments and details have been shown for the purpose of illustrating the subject invention, it will be apparent to those skilled in this art that various changes and modifications can be made therein without departing from the scope of the subject invention. In this regard, the scope of the invention is to be limited only by the following claims.

What is claimed is:

1. A multi-functional additive package comprising:

A) about 2.4 to about 90% by weight of a blend of:

I) at least one oxygen-containing compound comprising a polyisobutylene succinic acid or polyisobutylene succinic anhydride, II) at least one nitrogen-containing compound comprising the reaction product of a hydrocarbyl-substituted acylating agent and an amine or polyamine having from 2 to 18 carbon atoms, B) about 2.5 to about 90% by weight of at least one lubricity improver, wherein the lubricity improver is selected from gylcerol monooleate, sorbitan monooleate, oil-soluble hydrocarbyl substituted mono- and polycarboxylic acids or the anhydrides or amides thereof, wherein the hydrocarbyl substituent has up to 24 carbon atoms, and partial esters of the oil-soluble hydrocarbyl substituted polycarboxylic acids, wherein the hydrocarbyl substituent has up to 24 carbon atoms, C) about 2.5 to less than about 50% by weight of at least one solvent; and D) about 0.1 to about 30% by weight of a compatibilizer mixture containing a mixture of a $C_{1-10}$ alcohol and the reaction product of an alkyl succinic anhydride or its acid or ester derivative and an alkanolamine.

2. The additive package of claim 1, wherein the at least one nitrogen-containing compound comprises a polyisobutylene succinimide or a quaternized salt thereof.

3. The additive package of claim 1, wherein the ratio of B) to D) to C) is from about 25:2:4 to about 30:4:6 moles per mole.

4. The additive package of claim 1 further comprising E) about 5 to about 90% by weight of an antioxidant.

5. The additive package of claim 4, wherein the antioxidant is a phenolic antioxidant.

6. The additive package of claim 4, wherein the antioxidant is an aminic antioxidant.

7. The additive package of claim 5, wherein the antioxidant is a di-tertbutylphenol, such as 2,6-di-terbutylphenol.

8. The additive package of claim 1 wherein the ratio of the at least one oxygen-containing compound to the at least one nitrogen-containing compound is from about 1:0.1 to about 1:10 moles per mole.

9. The additive package of claim 1 having a kinematic viscosity as measured according to ASTM D445 at 40° C. of around 25 cSt.

10. A fuel composition for an internal combustion engine comprising a diesel fuel and an additive package as claimed in claim 1, wherein the additive package is present in the fuel in a concentration of between about 100 to about 500 ppm.

11. A method of operating an internal combustion engine comprising providing to the fuel an additive package as claimed in claim 1 at a concentration of between about 100 to about 500 ppm wt/wt.

12. The method of claim 11, wherein the fuel additive package is added to the fuel using on-board dosing system.

13. The method of claim 11, wherein the fuel comprises a diesel fuel.

* * * * *